United States Patent [19]

Robertson

[11] Patent Number: 4,987,339

[45] Date of Patent: Jan. 22, 1991

[54] ENHANCED SINGLE LAYER MULTI-COLOR LUMINESCENT DISPLAY WITH COACTIVATORS

[75] Inventor: James B. Robertson, Yorktown, Va.

[73] Assignee: The United States of America as represented by the United States National Aeronautics and Space Administration, Washington, D.C.

[21] Appl. No.: 338,379

[22] Filed: Apr. 13, 1989

Related U.S. Application Data

[63] Continuation-in-part of Ser. No. 140,185, Dec. 31, 1987.

[51] Int. Cl.[5] ..... H05B 33/14

[52] U.S. Cl. ..... 313/502; 313/503; 313/506; 428/690

[58] Field of Search ..... 313/463, 502, 503, 505, 313/506, 509; 357/17, 19, 29, 30; 428/690, 917

[56] References Cited

U.S. PATENT DOCUMENTS

| | | | |
|---|---|---|---|
| 4,717,606 | 1/1988 | Hale | 313/503 X |
| 4,733,128 | 3/1988 | Tohda et al. | 313/503 |
| 4,862,033 | 8/1989 | Migita et al. | 313/509 X |

*Primary Examiner*—Kenneth Wieder

*Attorney, Agent, or Firm*—Harold W. Adams; John R. Manning

[57] ABSTRACT

The invention is an enhanced single-layer, multi-color luminescent display 10' comprising an insulator substrate 11' and a single layer of host material 13' having a smooth, flat top surface deposited thereon that hosts one or more different activators, therein forming a pattern of selected and distinctly colored phosphor areas 14', 16' and 17' which may be green, red and blue respectively in the single layer of host material 13'. Transparent electrical conductor means 12' may be provided for subjecting selected areas of the pattern of colored phosphor areas to an electric field thereby forming a multi-color, single layer electroluminescent display. A coactivator such as phosphorus (P) may be selectively introduced into one or more of the phosphor areas 16' and 17' to enhance the brilliance of the color or colors of the one or more selected phosphor areas without changing the electric field.

A method of forming a multi-color luminescent display incudes the steps of depositing on an insulator substrate 10', a single layer of host material 12' with the properties to host varying quantities of different activators and a common activator into selected areas 14', 16' and 17' of said single layer of host material 12' as by thermal diffusion or ion-implementation to form a pattern of phosphor areas 16' and 17' of selectively enhanced colors in said single layer of host material 12'.

10 Claims, 4 Drawing Sheets

ENHANCED SINGLE LAYER MULTI-COLOR LUMINESCENT DISPLAY WITH COACTIVATORS

ORIGIN OF THE INVENTION

The invention described herein was made by an employee of the United States Government and may be manufactured and used by or for the Government for governmental purposes without the payment of any royalties thereon of therefor.

CROSS REFERENCE TO RELATED APPLICATIONS

This application is a continuation-in-part of pending U.S. application Ser. No. 140,185, filed Dec. 31, 1987.

BACKGROUND OF THE INVENTION

1. Field of the Invention

The invention is an enhanced single layer multi-color luminescent display and method of making and more particularly to thin-film electroluminescent displays.

Thin-film, multi-color electroluminescent (TFEL) flat-panel displays, because of their potential to provide improved improved flexibility and reliability while, reducing the weight, space, power consumption and degration characteristics of such devices, are finding greater use in the control panels of air, space and ground vehicles and many other applications requiring thin, flat, multi-colored displays.

2. Description of the Prior Art

Full-colored electroluminescent displays formed of patterned and stacked layers of phosphors separated by insulating layers and transparent conductors and frequently filters are generally known. For instances, see U.S. Pat. No. 4,689,522, dated Aug. 25, 1987 which discloses a full-color, thin-film electroluminescent device with two stacked substrates and color filters.

Multi-color electroluminescent displays formed by depositing side-by-side stripes of different colored phosphors on a common insulator substrate are also known. Two-color displays have also been achieved by selectively doping an active phosphor base layer of a first color with the coactivator manganese (Mn) by means of laser chemical vapor deposition to form an oxide coated phosphor of a second color on the surface of the phosphor base layer.

Conventional electroluminescent (EL) displays are generally divided into two major types according to the manner or form in which the phosphors are applied to the necessary substrate. These are thin-film electroluminescent (TFEL) and powder electroluminescent (powder EL) devices.

Powder EL devices are formed by grinding the phosphor crystals to be used into a powder, mixing the powder with a binder and a solvent, and then spreading the mixture (single color) onto a substrate by spraying or blading. TFEL devices are formed by growing the phosphors (single color) on a substrate using conventional techniques such as vapor deposition or sputtering.

Typically, the thickness of the phosphor layer in EL devices is about 20 to 40 $\mu$M while the thickness of the phosphor layer in a TFEL device is 0.4 0.5 $\mu$M. As is known the luminescence in a TFEL device is produced by a different mechanism than in a powder EL device.

To display the full color spectrum including white, a conventional TFEL device will typically have the three primary and separate colors, blue, green, and red phosphors, placed close together either side-by-side on the same substrate; on separate superimposed layers, or in some combination of these two fabrication techniques.

Typically, the three phosphors are applied to the substrate or substrates (in thicknesses of 2000 to 5000 Angstroms) by vacuum deposition. In conventional single layer TFEL devices alternating stripes of blue, green and red phosphors are grown on a glass substrate. In a two-layer TFEL device such as disclosed in U.S. Pat. No. 4,689,522, a single layer of blue phosphor is superimposed over a single layer of side-by-side alternating stripes of green and red phosphors.

The fabrication of a conventional multi-color TFEL device is generally as follows: After deposition a pattern of transparent electrodes on the surface of a glass substrate and covering it with a transparent layer of insulation, the following steps are performed: (1) a red phosphor is deposited as previously described over the insulated surface of the substrate (2) the phosphor coated surface is masked with a striped pattern (commonly with photo-resist); (3) plasma etching of the red phosphor; (4) removal of the photo-resist; (5) deposition of a green phosphor; (6) the addition of an insulating layer; (7) the repetition of steps (2), (3), and (4), after the deposition of each additional colored phosphor; and (8) annealing of the phosphors. Variations in this process may be made by changing the order and repetition of the above steps or by ion-beam etching instead of plasma etching.

As is apparent, a disadvantage of the prior art in making-color electroluminescent displays is the necessity of the etching steps, the depths and locations of which must be precisely controlled. For instance, in the first etching step, the etching must continue through the full depth of the red phosphor layer but must be stopped before going into the insulating layer. In the second etching step, the etching must continue through the full depth of the green phosphor but stop before entering the red phosphor layer. The etching also leaves an uneven surface on the underlying phosphor layer that is believed to promote dielectric breakdown in the covering insulating layer applied after etching is completed. As previously noted selective doping of an active phosphor base with manganese (Mn) also leaves an oxide coating having an uneven surface on the underlying base or layer.

OBJECTS AND SUMMARY OF THE INVENTION

An object of this invention is to provide an enhanced single-layer, multi-color luminescent display and method of making same.

Another object is to provide a multi-color luminescent display using a single-layer of an active host material having a smooth top surface that may be a phosphor material with the properties to serve as a host to different impurities or activators introduced into the single-layer in selected phosphor areas without disturbing the smooth surface and that form phosphor areas of different colors within the single-layer of host material.

Yet another object of the invention is to enhance the colors of selected phosphor areas within the single multi-color layer of material by introducing a coactivator therein without disturbing the smooth surface of the single-layer or that of the selected phosphor areas.

The above and numerous other objects are achieved by the invention which is a full colored, luminescent display that includes a single layer of an active host material having a smooth surface that itself may be a phosphor on an insulating substrate, the host layer serving as host to different impurities or activators that combine therewith in selected areas of said single host layer without disturbing the smooth top surface to form a pattern of phosphor areas of different colors within the host layer.

The activators may be introduced into the single-layer of active host material, which also may be a phosphor, by thermal diffusion, ion implantation or the like. The number of phosphors of different colors that may be provided is determined by the number and quantity of different impurities to which the single-layer of material can serve as a host. The colors of selected phosphor areas within the single layer of active host material may be enhanced by introducing a coactivator into the selected phosphor areas at the time the impurity or activator is introduce, within the single-layer of active host material or afterward in a separate step.

BRIEF DESCRIPTION OF THE DRAWINGS

The above and numerous other objects and advantages of the invention will become apparent from the detailed description when read in view of the appended drawings wherein.

DESCRIPTION OF THE PREFERRED EMBODIMENT

Figure 1:
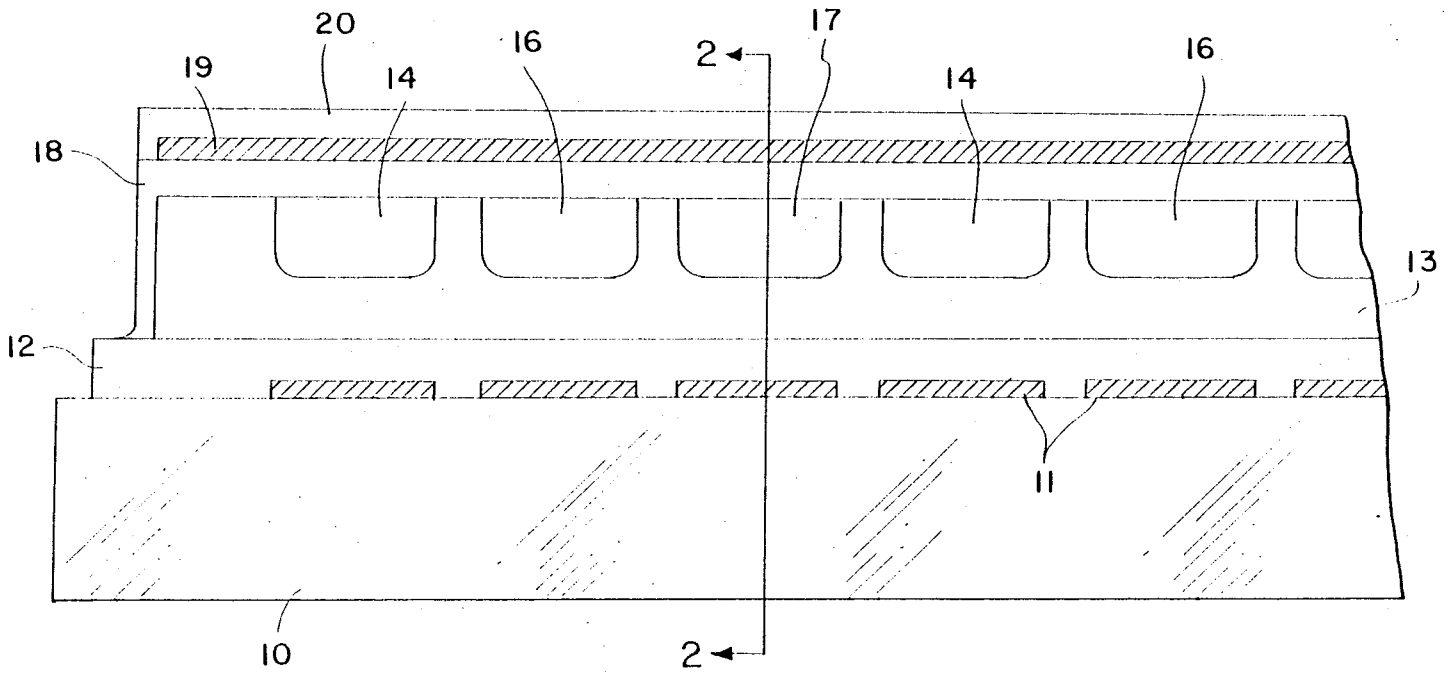
FIG. 1 is a sectional view illustrating a preferred embodiment of a single layer, three-color electroluminescent display and the method of making same in accordance with the invention.

As shown in FIG. 1, a preferred embodiment of the invention includes an insulating substrate 10 of glass or the like upon which a pattern of individual transparent column electrical conductors 11 is deposited before an insulating covering or layer 12 of $SiO_2$ or other suitable dielectric is applied over the column conductors 11 as is well known. Next, a single layer 13 of a host material such as ZnS is deposited by evaporation, sputtering, or other known thin film deposition technique.

The single layer of host material 13 serves as a common host to two or more different impurities or activators that when introduced into the common host material 13 in selected areas form a pattern of stripes, dots or other indicia of different colored phosphors in the single-layer of host material 13. As will be explained the single layer of host material 13 may be either luminescent or non-luminescent provided it has the properties to serve as a common host to different phosphor forming activators.

For instance, as shown in FIG. 1, a green phosphor strip 14 is produced by introducing the impurity $TbF_3$ to from ZnS:$TbF_3$. A red phosphor stripe 16 is achieved by introducing the activators $TbF_3$ and Mn into the host layer 13 of ZnS. A blue phosphor stripe 17 results by introducing the activator Mg to the host layer 13 of ZnS to form ZnS:Mg. Thus, by adding different activators to a single-layer of a host material 13 in selected areas, a pattern of phosphors of different colors is provided in the single layer of host material.

After annealing the layer of host material 13 and the phosphors 14, 16, and 17 formed formed therein, a second transparent layer 18 of $SiO_2$ or other suitable dielectric is applied over the layer of host material 13. A pattern of row electrical conductors 19 is deposited over the dielectric layer 18. The column and row conductors 11 and 19 form a matrix permitting selected portions of the layer of host material 13 to be subjected to an electric field established between the column and row conductors as is well known.

A preferred method of making a single layer electroluminescent display begins with a glass substrate 10 upon which a pattern of transparent and individual column conductors 11 of indium-tin oxide is deposited and over which a covering insulator layer 12 of $SiO_2$ or other suitable dielectric is deposited as by sputtering or other conventional deposition techniques.

Thereafter a single layer of host material 13 of ZnS or a phosphor of a selected color capable of hosting one or more activators to form phosphors of different colors is deposited by evaporation, sputtering or other known thin film deposition technique over the entire surface of the insulator layer 12. The host layer 13 of ZnS is then covered with a metal mask to form a predetermined pattern of exposed and unexposed surface area on the host layer 13 as required to form the desired electroluminescent display. Thereafter the activator $TbF_3$ is introduced in sufficient quantity through the mask or photoresist into the host layer 13 of ZnS to produce one or more stripes 14 of green phosphor ZnS:$TbF_3$ within and without disturbing or substantially changing the smooth, flat top surface of the host layer 13. The mask is then repositioned on the surface of the host layer 13 of ZnS to form the next required pattern of exposed and unexposed surface areas on the host layer 13 of ZnS before the activators $TbF_3$ and Mn are introduced into the newly exposed areas of the host layer 13 in sufficient quantity for forming one or more stripes 16 of red phosphor ZnS:$TbF_3$:Mn within and without disturbing or substantially changing the smooth, flat top surface of the host layer 13.

Again the metal mask is repositioned to form a third pattern of exposed areas on the surface of the host layer 13 of ZnS. Thereafter the activator Mg is introduced into the newly exposed area of the host layer 13 in sufficient quantity to form one or more stripes 17 of blue phosphor ZnS:Mg within and without disturbing or substantially changing the smooth, flat top surface of the host layer 13. Thus, a smooth, full-color luminescent display surface is achieved. The activators may be introduced into the host layer 13 by thermal diffusion in a vacuum or inert atmosphere, ion-implementation; or other suitable techniques that do not disturb or substantially change the smooth, flat top surface of the host layer as shown in FIGS. 1–4.

After annealing the host layer 13 and the phosphor stripes 14, 16, and 17 therein, a pattern of individual, transparent row electrical conductors 19 embedded in a second transparent layer 18 of $SiO_2$ or other suitable dielectric material is applied over the host layer 13, the $SiO_2$ forming an insulator between the phosphor stripes 14, 16, and 17 and the row electrical conductors 19 which which the column electrical conductors 11 for a matrix for subjecting selected portions of the phosphor stripes 14, 16, and 17 to an electric field to provide an electroluminescent display.

As mentioned luminescent and electroluminescent displays can be made in accordance with the invention using any single layer 13 of host material into which activators can be introduced to form phosphors of different colors in the single layer of host material. For example, the phosphors $SrS:Ce_2S_3$ red) and $SrS:CeF_3$ (green) may be formed in a single host layer 13 of SrS to provide two distinct colors.

Figure 3:
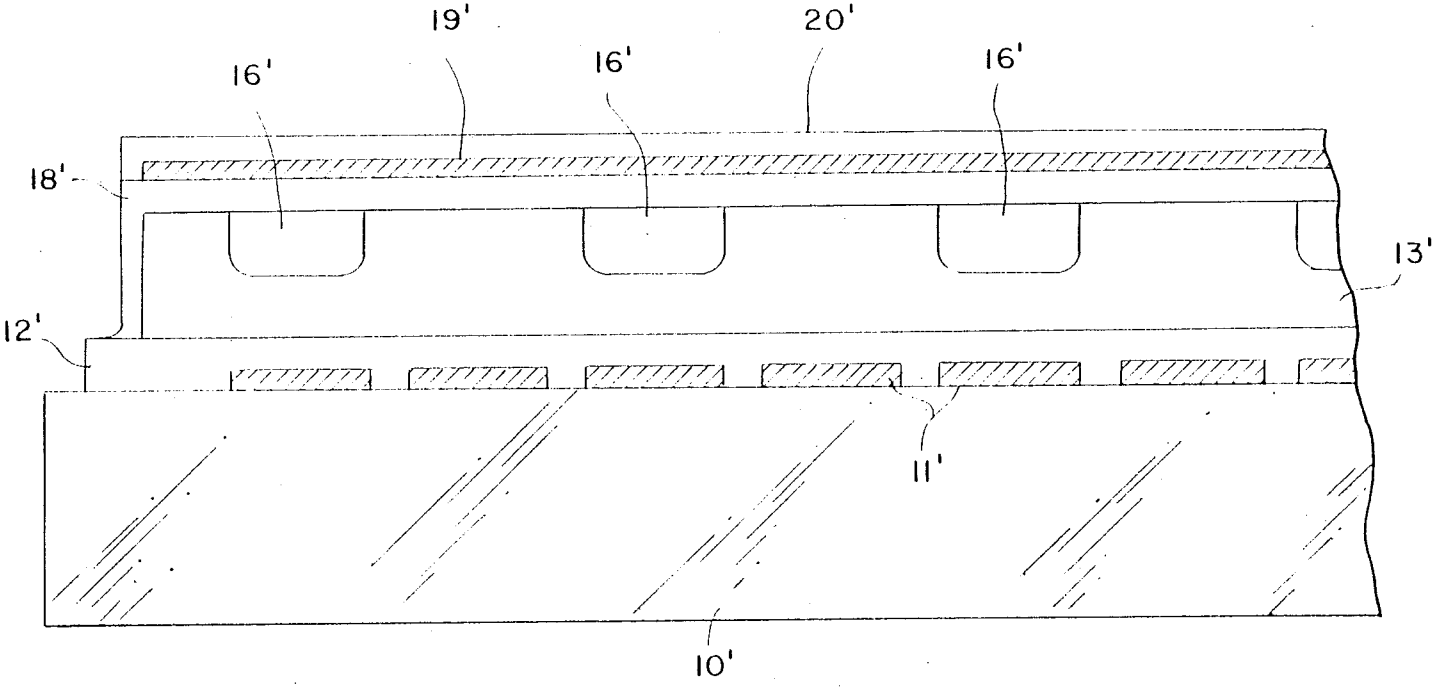
FIG. 3 is a sectional view illustrating a single layer, two-color display and method of making same in accordance with the invention.

As shown in FIG. 3, luminescent and electroluminescent displays of two or more colors may be made in accordance with the invention using the green phosphor $ZnS:TbF_3$ as the single layer 13'of host material into which the activator Mn is introduced as previously described to form stripes 16' of the red phosphor $ZrS:TbF_3:Mn$. Again, the number of phosphors of different colors that can be formed is determined by the number of different impurities the single layer 13' of phosphor is capable of serving as a host as previously explained.

Figure 2:
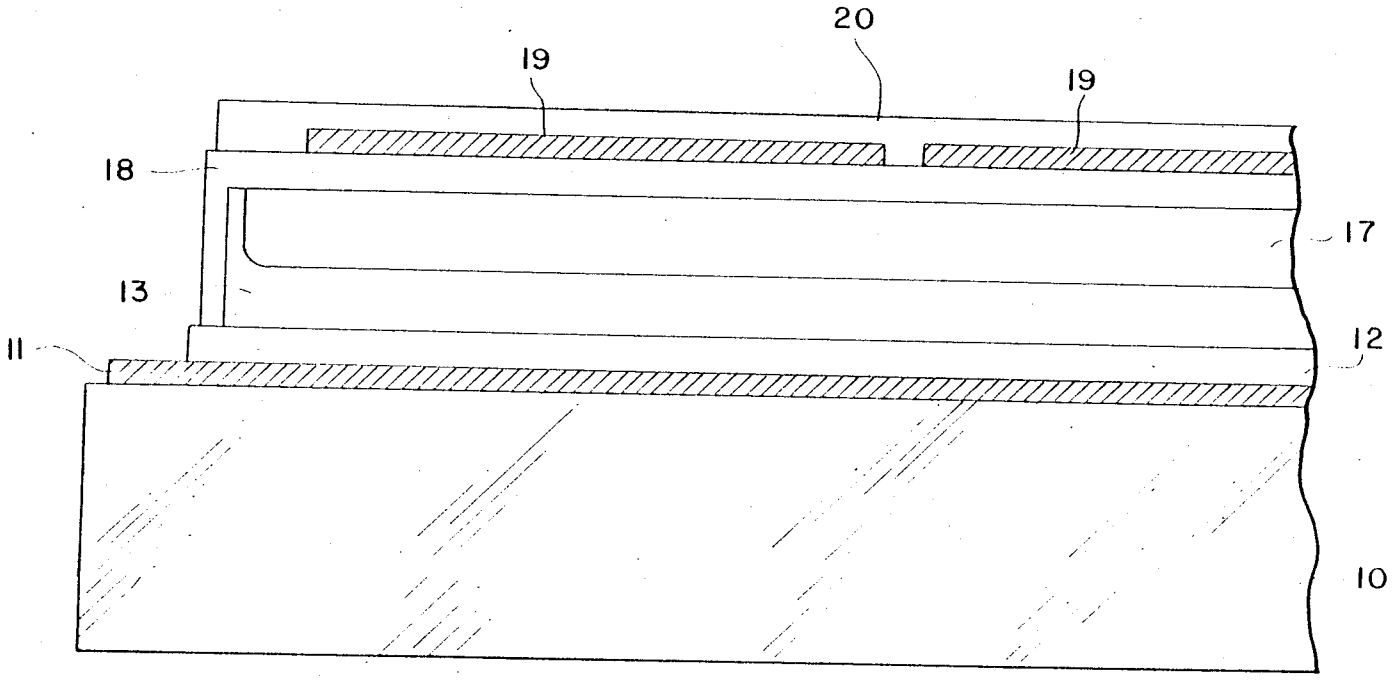
FIG. 2 is a cross-sectional view taken along the lines 2—2 in FIG. 1.

As shown in FIG. 3, an electroluminescent display may be fabricated as shown in FIGS. 1 and 2, like elements having the same reference numeral except for the prim (') symbol—thus, 13 and 13' identifying the different single layers of host material in the two embodiments. As is shown, the method of this invention eliminates the need for the difficult and costly steps of etching, thereby increasing the yield while reducing the cost of making full or multi-color thin film luminescent and electroluminescent displays.

Depositing only a single layer of host material on an insulator substrate, leaves a smooth, flat, top surface on the single layer as shown in FIGS. 1–3 which remains substantially smooth, flat and unchanged after the selected activators are introduced as previous explained. This eliminates the sharp corners and edges left by the overlapping layers of phosphors and undesirable oxide coatings found in conventional, multi-layer TFEL displays. Such irregular and rough surfaces may cause corresponding sharp corners in the succeeding layers of insulation and transparent conductors leading to a dielectric breakdown of the insulating layers.

The maximum brightness or brilliance of the selected phosphor areas formed by introducing selected impurities or activators into the single layer of host material as previously described can be enhanced by the addition of small amounts (one-tenth to ten percent), of a coactivator such as phosphorus (P) into the respective colored phosphors selected. If the single layer of host material is zinc sulfide (An) and the activator selectively introduced therein to form a desired colored phosphor is one or more of a group of activators such as manganese (Ms), magnesium (Mg), a rare earth element, halides or the like for which the single layer of material can serve as a host, then the addition of phosphorus (P) as a coactivator in small amounts into the selected phosphor area formed in the single layer will enhance the maximum brightness or brilliance of the color of the selected phosphor area without otherwise requiring a change in the excitation voltage.

Figure 4:
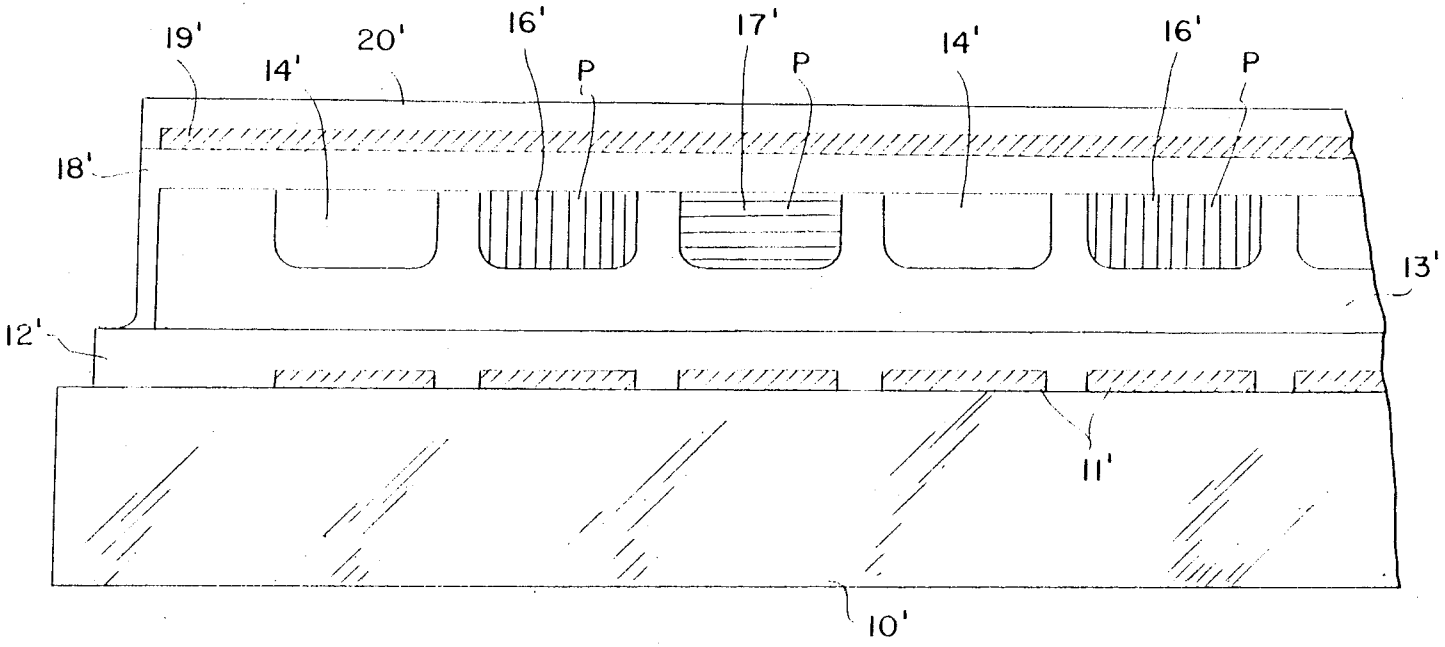
FIG. 4 is a sectional view illustrating a preferred embodiment of a single layer, three-color electroluminescent display and method of making same in which the colors of one or more selected phosphor areas in the single layer are enhanced in accordance with the invention.

For example, referring to FIG. 4, if it is desired to enhanced or increase the brilliance or brightness of the red and blue phosphor regions 16' and 17' formed in the single layer of host material 13', then a small amount of phosphorus (P) ranging from one-tenth to ten mole percent may be introduced into the activator forming the respective phosphor regions 16' and 17' by ion-implantation. This may also be accomplished by thermal diffusion in an inert atmosphere or vacuum, or other thin film technique that avoids disturbing the smooth, flat surface of the single-layer of host material 13' as shown in FIG. 4.

If phosphorus (P) is introduced into selected phosphor areas 14', 16' and 17' of the single-layer of host material 13', patterns of colors of increased brightness within the selected phosphor areas may be formed without changing the initial excitation.

Alternative methods of introducing phosphorus (P) as a coactivator into the single-layer host material 13' may be used depending upon whether the phosphorus (P) is desired to be introduced into the entire single layer of ZnS 13' or in selected phosphor areas 16' and 17' as previously described.

If the coactivator (P) is desired in the entire single layer of ZnS 13', it can be introduced in the required quantity (one-tenth to ten mole percent) during the growth or deposit of the single-layer of ZnS host material 13' is or by ion-implementation or thermal diffusion of P into the ZnS layer 13' after it is formed on the substrate 12'. This is also accomplished without substantially changing the smooth, flat surface of the single-layer of host material 13' as previously described and as shown in FIG. 4.

If a coactivator (P) is desired only in selected areas such as 16' or 17' it can be introduced into the single-layer 13' after the activator forming the colored phosphor area 16' or 17' is introduced as previously described or simultaneously therewith by thermal diffusion through a patterned mask using a compound of the selected activator and coactivator (P) as a source. In any of the above alternative methods of introducing P as a coactivator, the resulting ZnS layer 13' is left with a flat, smooth top surface as shown in FIG. 4.

While the invention has been described as an enhanced multi-color, single layer electroluminescent display device (TFEL) and a method of making the same, the method of this invention may be used to make a multi-color, single phosphor layer substrate for use in cathode ray tubes and other similar applications requiring such a multi-color phosphor display surface.

While preferred embodiments of a multi-color, single phosphor layer electroluminescent display and methods of making same have been described in detail, numerous changes and modifications can be made within the principle of the inventions which are to be limited only by the appended claims.

What is claimed is:

1. An enhanced, single-layer multi-color luminescent surface comprising:

an insulator substrate;

a single layer of host material having a smooth top surface on said substrate, said single layer of host material including different activators within selected areas therein forming a pattern of one or more phosphor areas of selected and distinct colors within said single layer of host material; and a coactivator selectively introduced into one or more or said phosphor areas thereby enhancing the brilliance of the color of colors thereof.

2. The invention as defined in claim 1 wherein said single-layer of host material is a phosphor.

3. The invention as defined in claim 1 including an insulating layer over said smooth top surface of said single-layer of host material.

4. The invention as defined in claim 3 including electrical conductor means for subjecting selected phosphor areas of said pattern of phosphor areas of different colors to an electric field thereby forming a multi-color, single-layer electroluminescent display.

5. An enhanced single-layer, multi-color electroluminescent display including electrical conductor means for subjecting selected phosphor areas of different colors in said display to an electric field to display the colors of said selected phosphor areas, the improvement comprising:

a single layer of host material having a smooth top surface and one or more different activators within said selected areas, said different activators forming a pattern of two or more phosphor areas of different colors within said single layer of host material; and a coactivator selectively introduced into said phosphor areas thereby enhancing the brilliance of the respective colors thereof when subjected to said electric field.

6. The invention as defined in claim 5 wherein said single layer of host material is formed of ZnS, and said activators hosted therein are Mg, $TbF_3$ and Mn thereby forming three different colored phosphors in said single layer of host material, namely: ZnS:Mg (blue); ZnS:$TbF_3$ (green); and ZnS:Mn:$TbF_3$ (red) respectively.

7. The invention as defined in claim 5 wherein said coactivator is phosphorus.

8. The invention as defined in claim 5 wherein said single layer of host material is formed of SrS, said activators hosted therein are $Ce_2S_3$ and $CeF_3$ forming two different phosphor areas of different colors therein, namely: SrS:$Ce_2S_3$ (red) and SrS:$CeF_3$ (green); and said coactivator selectively introduced into said phosphor areas is phosphorus (P).

9. The invention as defined in claim 7 wherein said single layer of host material is formed of ZnS, and said activators hosted therein are Mg, $TbF_3$ and Mn thereby forming three different colored phosphors in said single layer of host material, namely: ZnS:Mg (blue); ZnS:$TbF_3$ (green); and ZnS:Mn:$TbF_3$ (red) respectively.

10. The invention as defined in claim 7 wherein said single layer of host material is formed of SrS, said activators hosted therein are $Ce_2S_S$ and $CeF_3$ forming two different phosphor areas of different colors therein, namely: SrS:$Ce_2S_3$ (red) and SrS:$CeF_3$ (green); and said coactivator selectively introduced into said phosphor areas is phosphorous (P).

* * * * *